US008220117B2

(12) United States Patent
Lovato

(10) Patent No.: US 8,220,117 B2
(45) Date of Patent: Jul. 17, 2012

(54) BUCKLE STRUCTURE

(75) Inventor: Attilio Lovato, Pino Torinese (IT)

(73) Assignee: National Molding Italia S.r.l, Cambiano (Torino) (IT)

( * ) Notice: Subject to any disclaimer, the term of this patent is extended or adjusted under 35 U.S.C. 154(b) by 664 days.

(21) Appl. No.: 12/309,456

(22) PCT Filed: Jul. 19, 2007

(86) PCT No.: PCT/IB2007/052882

§ 371 (c)(1),
(2), (4) Date: Jan. 16, 2009

(87) PCT Pub. No.: WO2008/010193

PCT Pub. Date: Jan. 24, 2008

(65) Prior Publication Data

US 2009/0271957 A1 Nov. 5, 2009

(30) Foreign Application Priority Data

Jul. 19, 2006 (IT) ..... TO2006A0530

(51) Int. Cl.
*A44B 19/00* (2006.01)

(52) U.S. Cl. ..... 24/593.11; 24/573.09

(58) Field of Classification Search ..... 24/573.09, 24/578.15, 579.09, 579.11, 591.1, 596.1, 24/629, 604, 606, 653, 16 PB
See application file for complete search history.

(56) References Cited

U.S. PATENT DOCUMENTS

| | | | | |
|---|---|---|---|---|
| 215,956 | A * | 5/1879 | Miller | 24/574.1 |
| 809,465 | A * | 1/1906 | Roy | 24/593.11 |
| 1,910,891 | A * | 5/1933 | Freysinger | 24/593.11 |
| 3,385,299 | A * | 5/1968 | Le Roy | 606/218 |
| 3,860,997 | A * | 1/1975 | Van Riper et al. | 24/16 PB |
| 4,577,375 | A * | 3/1986 | Beaussant | 24/593.1 |
| 5,184,352 | A * | 2/1993 | Maufette | 24/579.09 |
| 5,400,484 | A * | 3/1995 | Gay | 24/593.11 |
| 6,041,479 | A * | 3/2000 | Colpo | 24/606 |
| 7,117,569 | B2 * | 10/2006 | Bledsoe | 24/593.11 |
| 7,254,872 | B2 * | 8/2007 | Ross | 24/163 K |
| 2009/0293234 | A1 * | 12/2009 | Chang et al. | 24/16 PB |

FOREIGN PATENT DOCUMENTS

| | | |
|---|---|---|
| CH | 286 603 | 10/1952 |
| EP | 0 345 014 | 12/1989 |

* cited by examiner

*Primary Examiner* — Robert J Sandy
*Assistant Examiner* — Michael Lee
(74) *Attorney, Agent, or Firm* — Collard & Roe, P.C.

(57) ABSTRACT

A buckle structure has a female part and a male part. The female part has a cavity for insertion of an axial tab formation of the male part, which has transverse seats on opposite lateral edges for engagement by fastening members on the female part. The fastening members have teeth located on opposite sides of a longitudinal direction of coupling of the buckle, which form between them a transverse aperture for the insertion of the tab formation. The buckle has button-like release members connected to the fastening members and operable manually by pressing transverse to the buckle, to disengage the fastening members from the seats. The fastening members and the release members act in coinciding or parallel transverse directions, so that the simultaneous pressing of the buttons towards each other causes the fastening teeth to move away from the engagement seats on the tab formation.

15 Claims, 10 Drawing Sheets

Figure 1A:
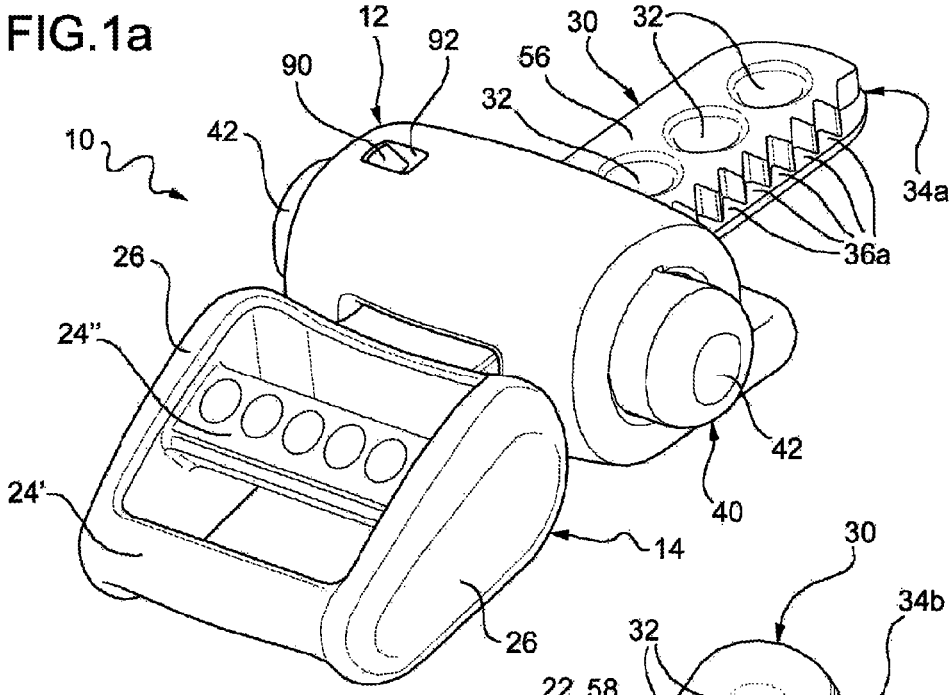

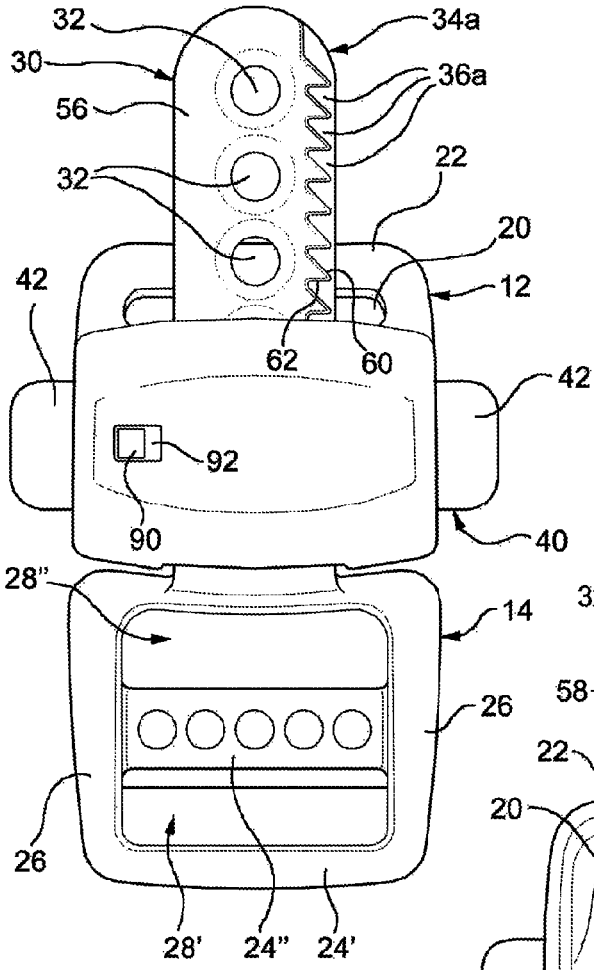
FIG.2a
FIG.2b
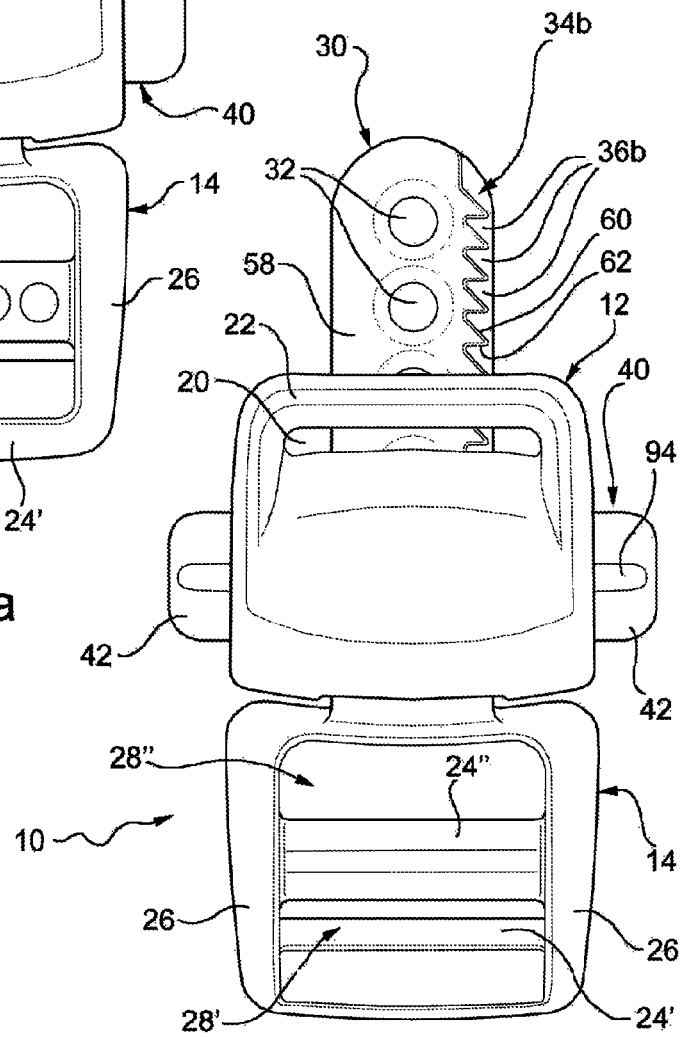

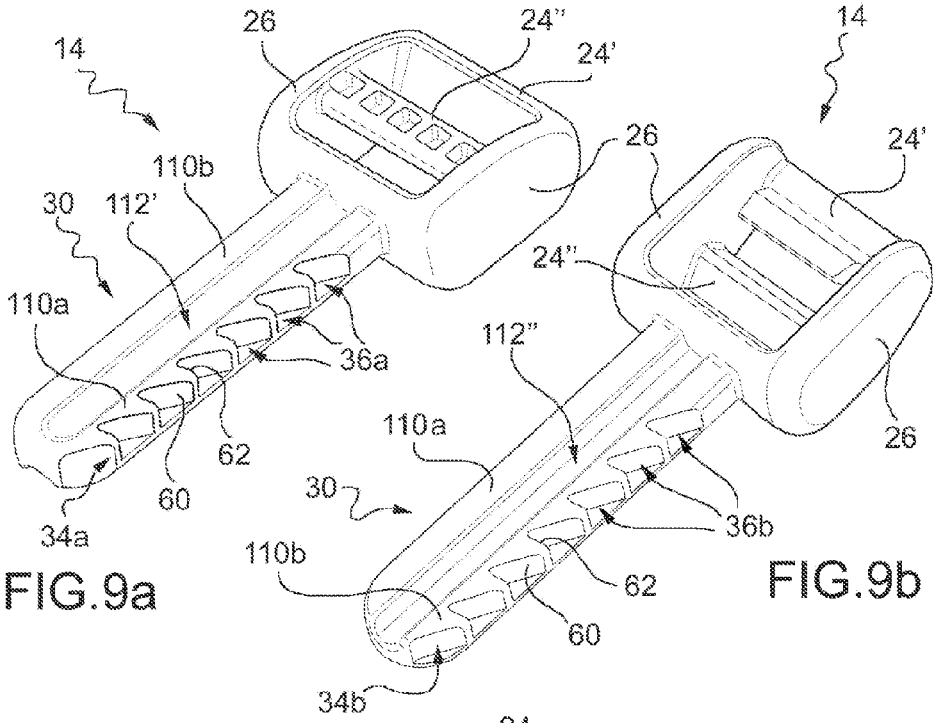
FIG.9a
FIG.9b
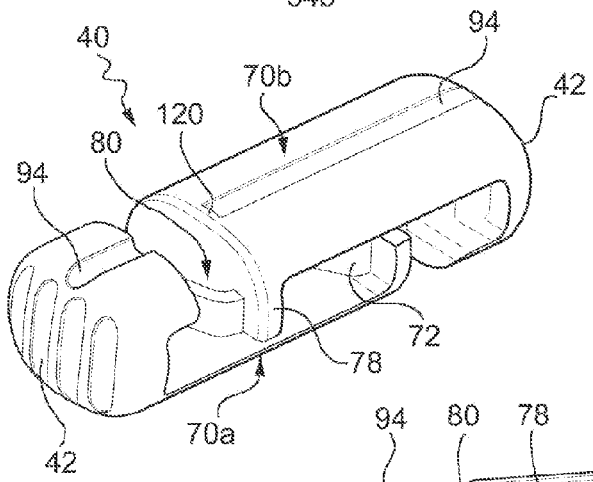
FIG.10a
FIG.10b
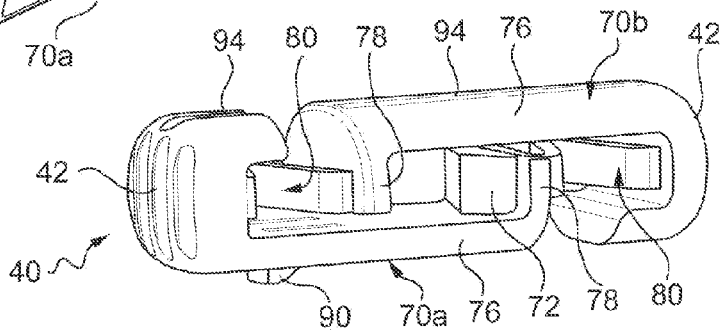

BUCKLE STRUCTURE

CROSS REFERENCE TO RELATED APPLICATIONS

This application is the National Stage of PCT/IB2007/052882 filed on Jul. 19, 2007, which claims priority under 35 U.S.C. §119 of Italian Application No. TO2006A000530 filed on Jul. 19, 2006. The international application under PCT article 21(2) was published in English.

The present invention relates to a buckle structure, and in particular a buckle structure which can be used for the rapid adjustment of a strap or as a quick-release connection device for bags, rucksacks and equipment for sports or leisure purposes.

There are known adjustable fastening devices, for example for retaining systems of a headgear such as a helmet, or for adjusting straps of equipment for the pursuit of sports, which have a buckle structure comprising a retaining body provided with a cavity for the sliding of a strap having transverse toothing and with hook means for locking the strap in an adjusted fastening position. The hook means are carried by a flexible tab which can be raised from a position in which they project into the strap sliding cavity and engage the transverse toothing of the strap, using wedge members actuated by two buttons which can be pushed towards each other in a direction parallel to the toothing of the strap.

There are also known quick-release buckles for bags, rucksacks and equipment for sports or leisure purposes, or for articles of clothing, comprising a male part and a female part which can be snap-fitted together and each of which has means for connection to a corresponding portion of tape associated with a corresponding element to be coupled. The female part is provided with a cavity into which a pair of sprung ribs of the male part can be snap-fitted, these ribs being deformed by interference with the lateral walls of the female part and then snapping back into their non-deformed state when they engage with corresponding lateral seats formed by apertures in the lateral walls of the female part, thus creating a condition in which the parts of the buckle are fastened together. In this condition, the male part of the buckle can be disengaged from the female part by pressing the button-like exposed portions of the ribs towards each other.

Buckle structures designed to meet the requirements of adjustment or connection as described above are generally different.

The object of the present invention is to provide a universal solution for the fastening and operation of a buckle, which can be used both for strap adjusting buckles which can assume a plurality of fastening positions and for quick-release buckles which can assume only two operating positions, namely a fastened condition and an unfastened condition.

A further object of the present invention is to provide a buckle structure which is easy to produce at low cost, but which can provide high tensile strength in the fastened condition and in any position of adjustment of a strap, as required for example for sports applications or for safety closures, without adversely affecting the practicality of use.

According to the present invention, this object is achieved by means of a buckle having the characteristics claimed in Claim 1.

Specific embodiments of the invention are the subject of the dependent claims.

Briefly, the present invention is based on the principle of providing a buckle with a transverse fastening and operating arrangement, in which a fastening mechanism associated with a female part of the buckle is engaged in corresponding engagement seats formed on an axial tab formation of a male part of the buckle by means of a pair of opposed fastening teeth acting in a direction transverse to the direction of coupling of the parts of the buckle, and in which the direction of operation of the fastening teeth is parallel to, and preferably coincides with, the direction of operation of a pair of buttons arranged for the operation of unfastening the buckle.

This operating configuration can advantageously be applied both for coupling a male part of a buckle comprising a tab with a plurality of engagement seats for the adjustment of the extension of a strap, and for coupling a male part of a buckle which has engagement seats for coupling to the female part in a single connection position.

Figure 1B:
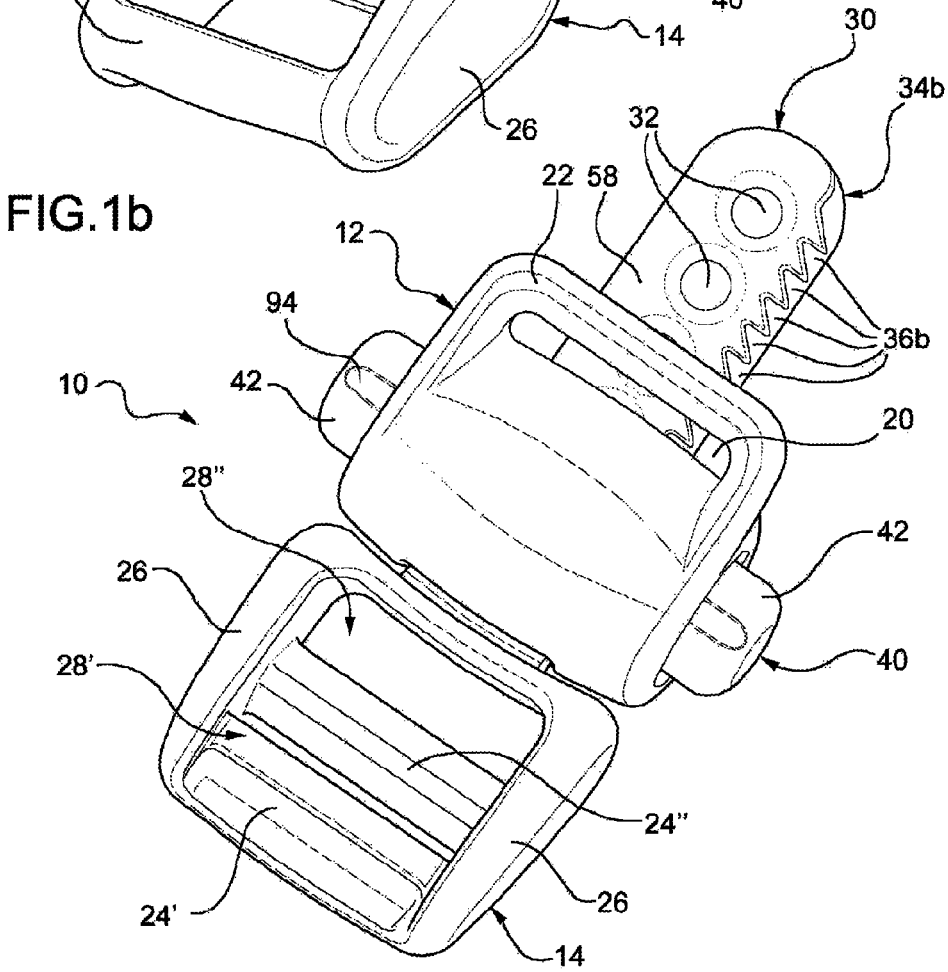
Figure 2C:
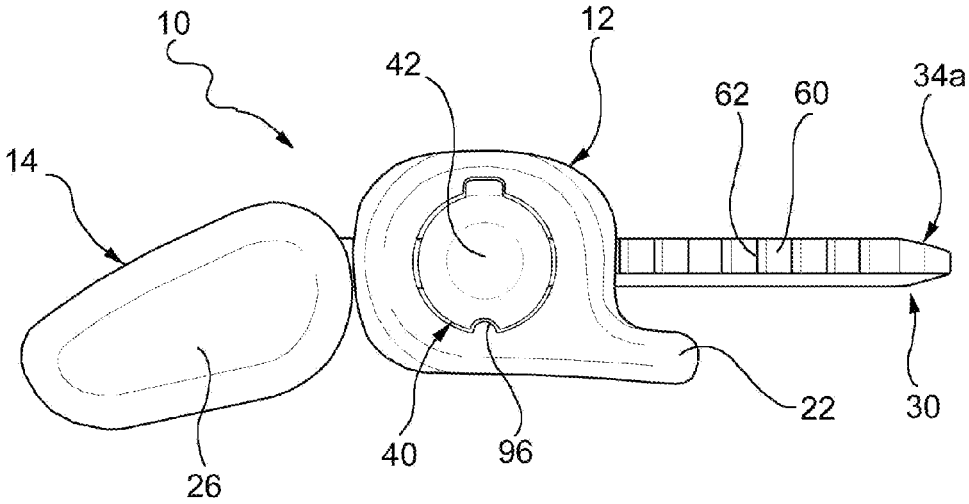

Other features and advantages of the invention will be revealed more fully in the following detailed description which is given by way of non-limiting example with reference to the appended drawings, in which:

FIGS. 1*a* and 1*b* show in two perspective views, dorsal and ventral respectively, a first example of embodiment of a buckle proposed by the invention, of the type which can be used for the rapid adjustment of a strap;

FIGS. 2*a*, 2*b* and 2*c* show, respectively, a view in elevation from above, a view in elevation from below, and a view in side elevation of the buckle of FIGS. 1*a* and 1*b;*

Figure 3:
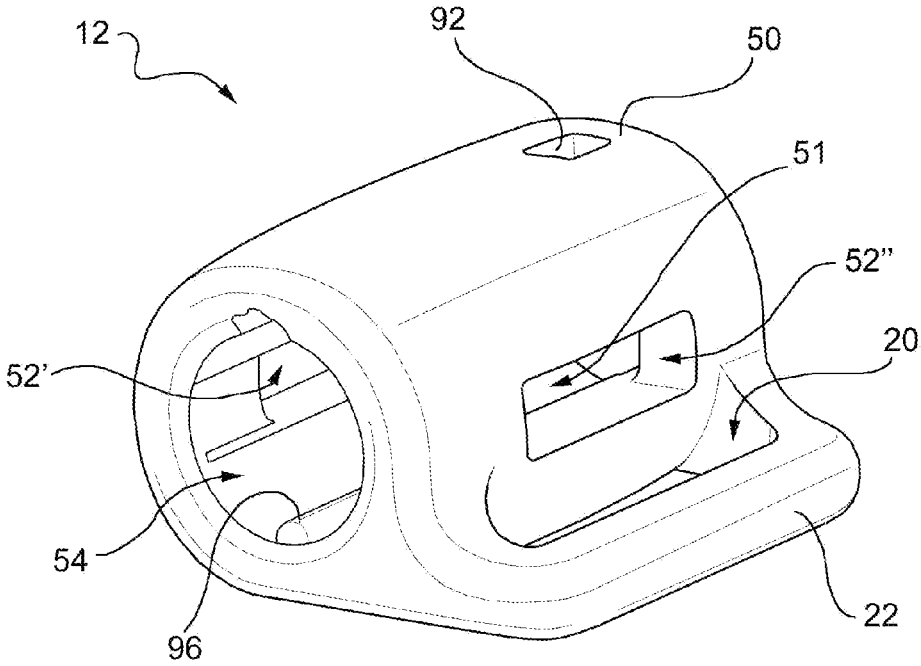
Figure 4A:
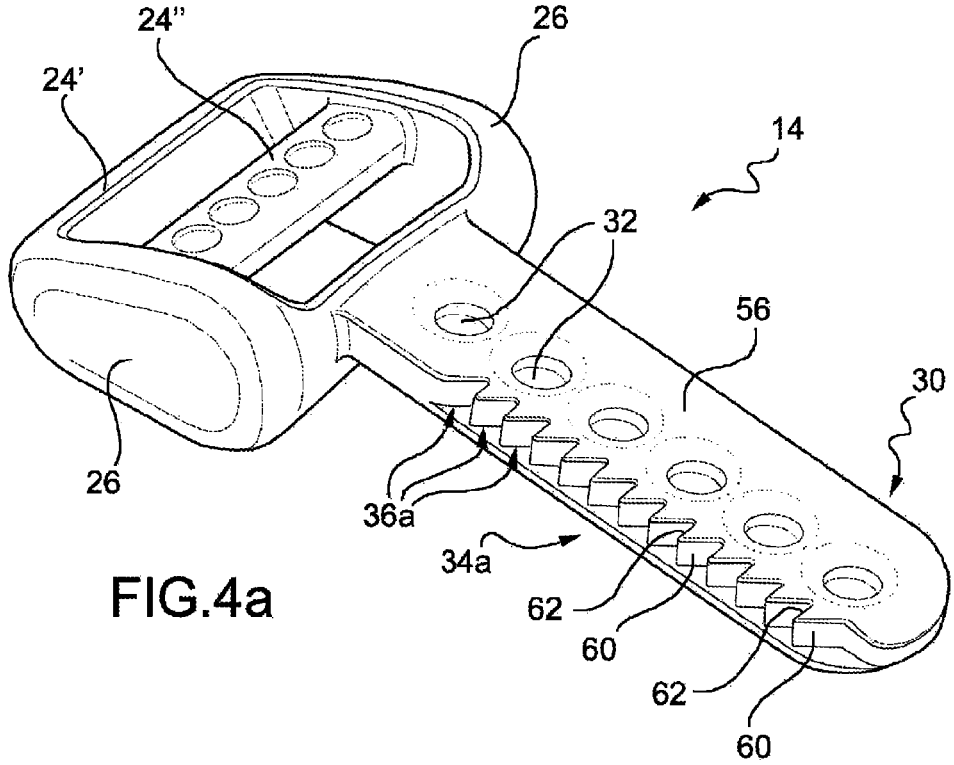
Figure 4B:
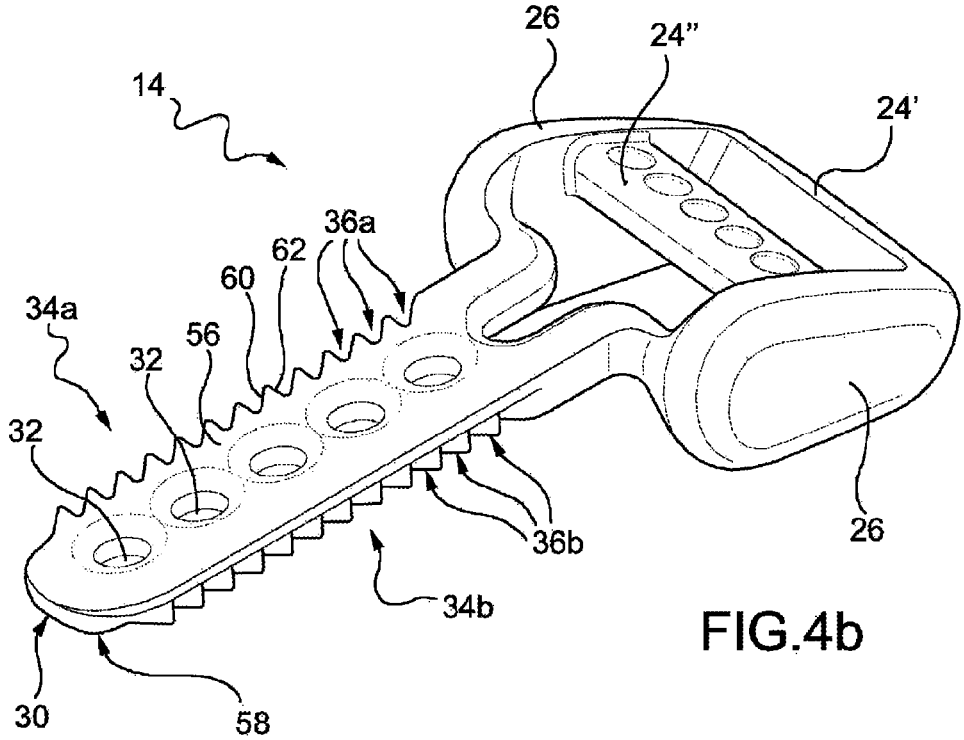
Figure 5:
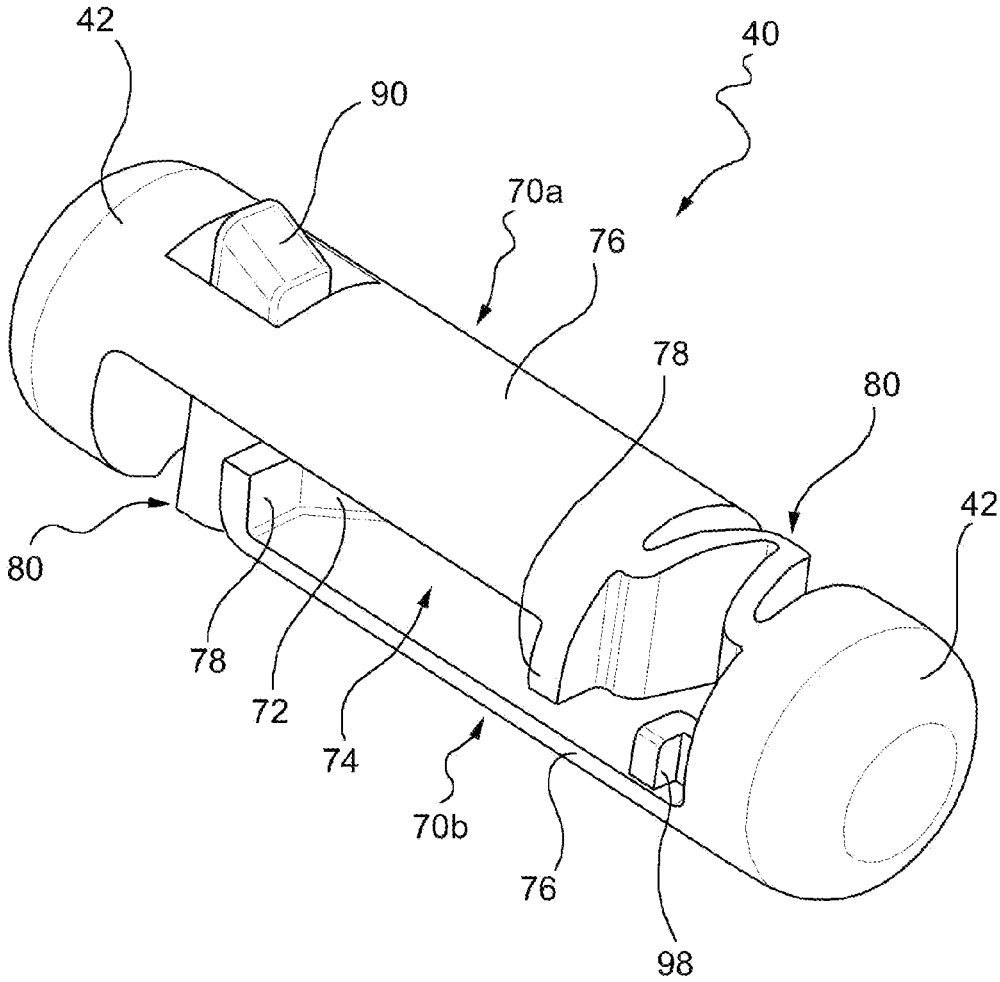
Figure 6A:
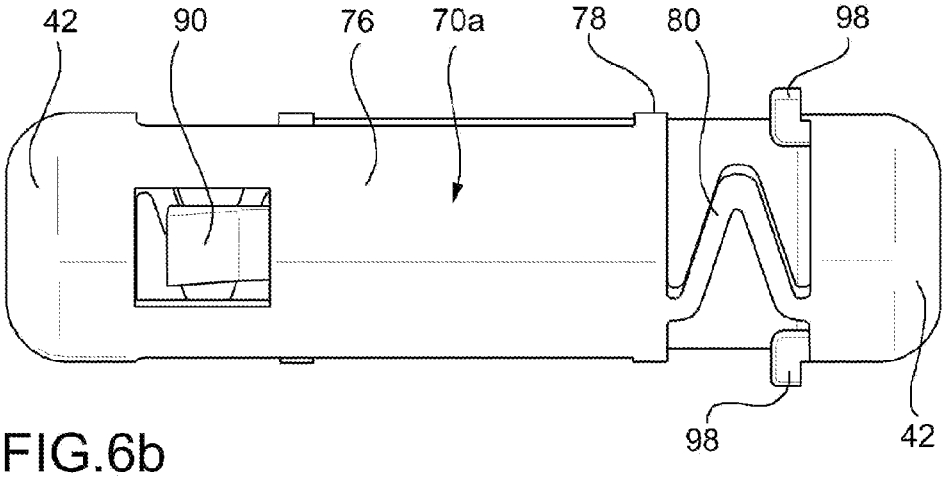
Figure 6B:
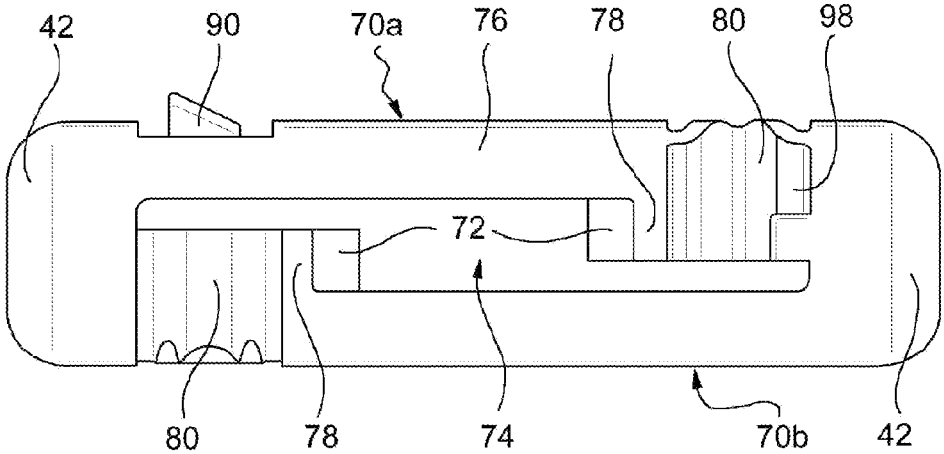
Figure 6C:
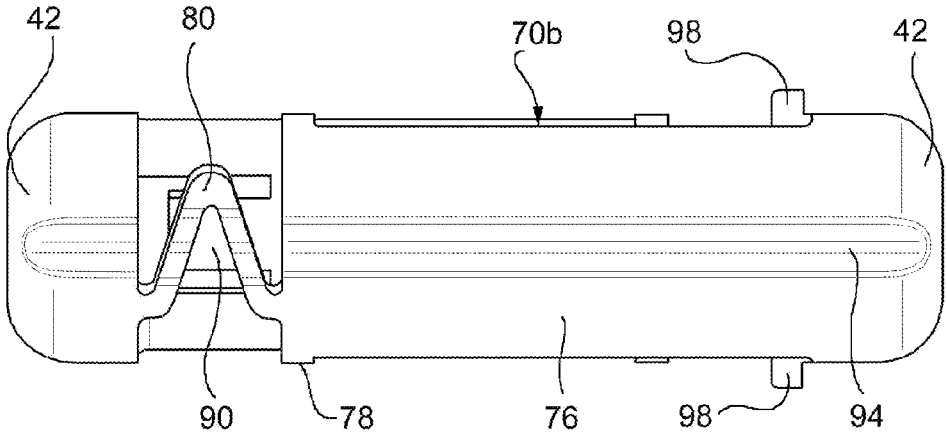
Figure 7A:
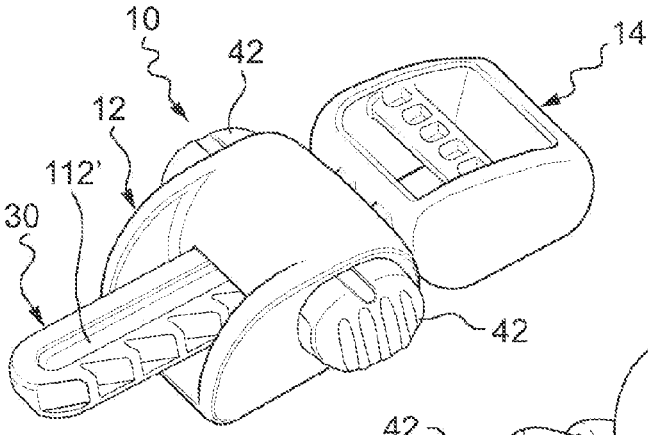
Figure 7B:
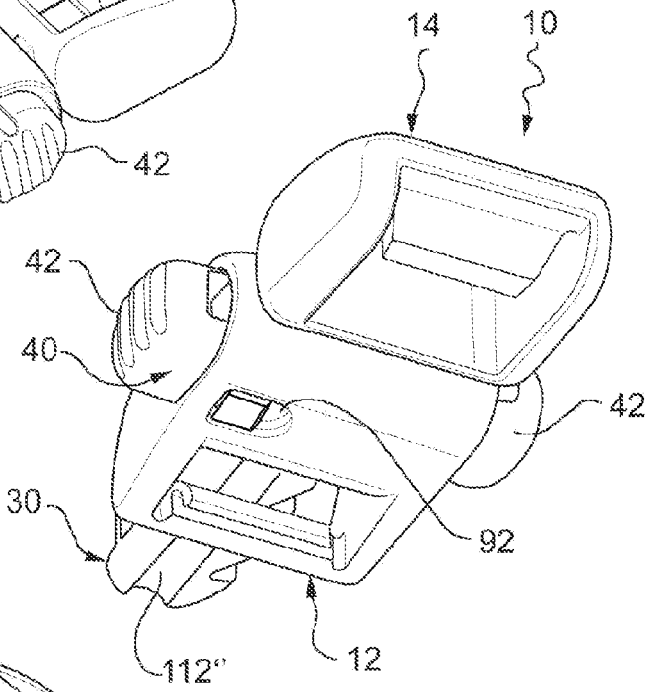

FIG. 3 shows a perspective representation of the body of the female part of the aforesaid buckle;

FIGS. 4*a* and 4*b* are perspective views from both sides of a male part of the aforesaid buckle;

FIG. 5 is a perspective view of an operating mechanism of the aforesaid buckle;

FIGS. 6*a*, 6*b* and 6*c* are views in rotated side elevation of the operating mechanism of FIG. 5;

FIGS. 7*a* and 7*b* are perspective views, dorsal and ventral respectively, of a variant embodiment of the buckle shown in FIGS. 1*a* and 1*b;*

Figure 8A:
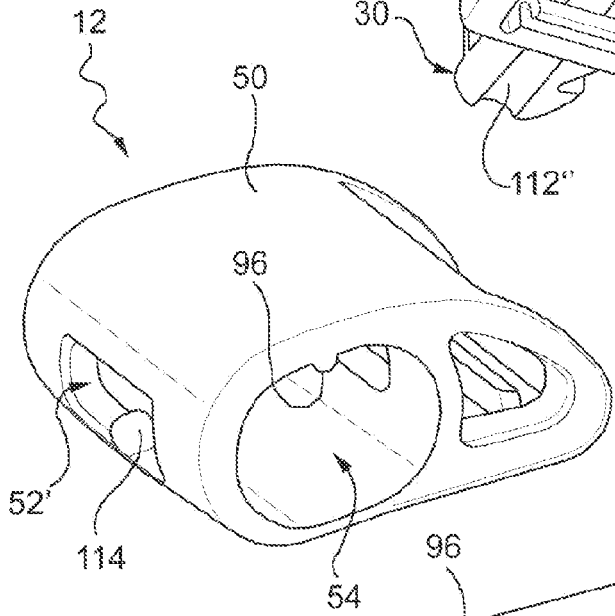
Figure 8B:
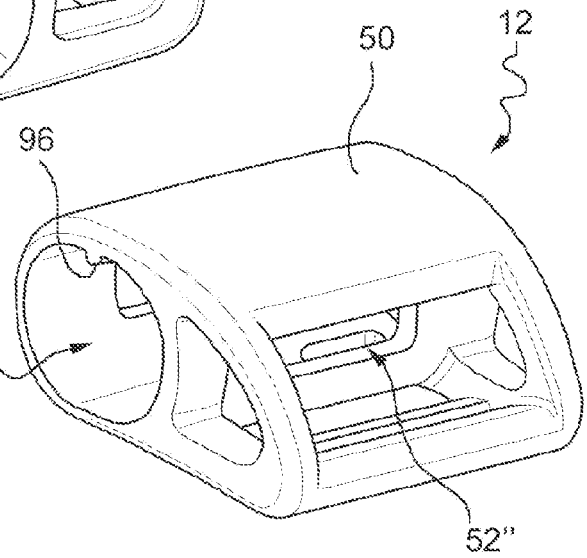

FIGS. 8*a* and 8*b* are two perspective views of a body of the female part of the buckle of FIGS. 7*a* and 7*b;*

FIGS. 9*a* and 9*b* are perspective views, dorsal and ventral respectively, of a male part of the buckle of FIGS. 7*a* and 7*b;*

Figure 11A:
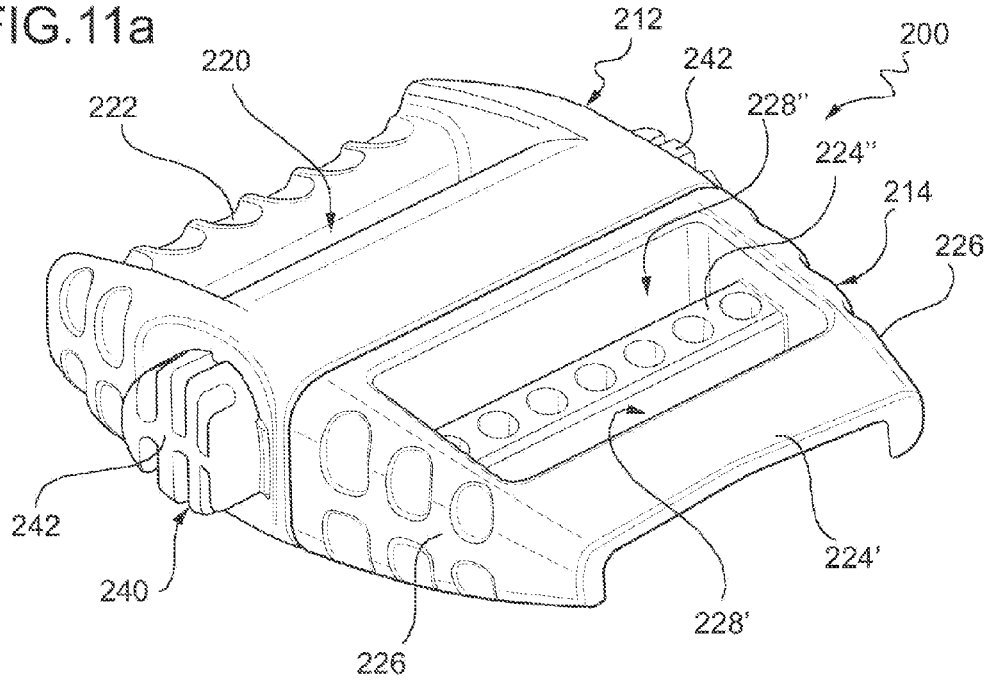
Figure 11B:
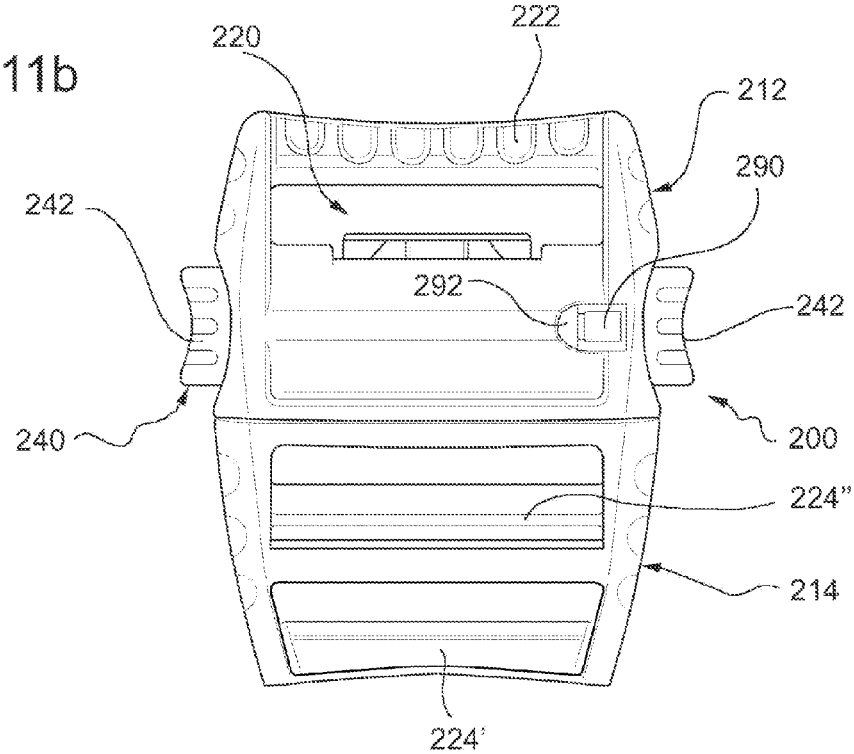
Figure 11C:
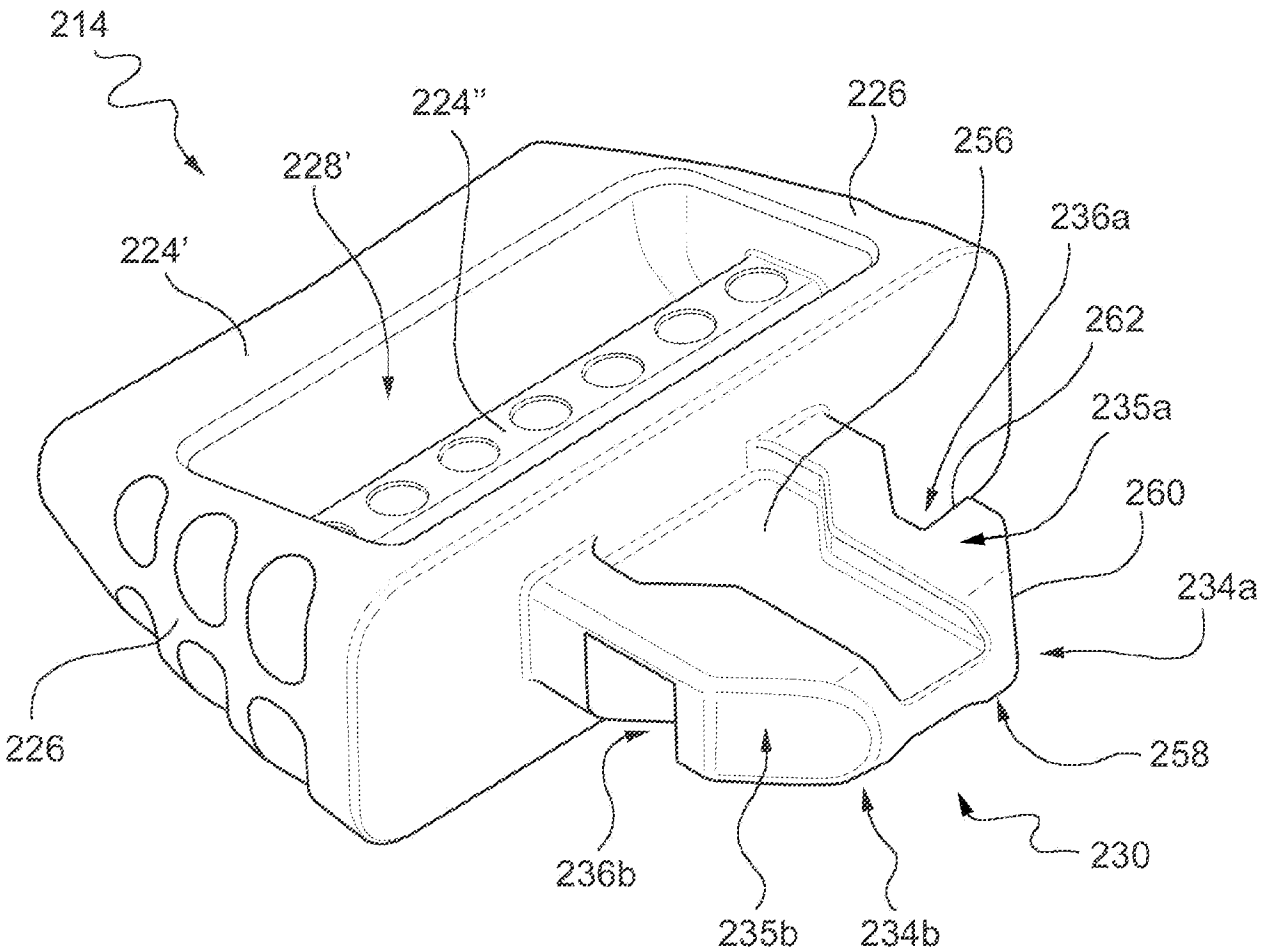

FIGS. 10*a* and 10*b* are two perspective views of the operating mechanism of the buckle of FIGS. 7*a* and 7*b*; and FIGS. 11*a*, 11*b* and 11*c* are views of a second embodiment of a buckle according to the invention, of the type which can be used for the rapid connection of accessories, equipment and articles of clothing, showing, respectively, an overall perspective view, a view in elevation from below, and a perspective view of the male part of the buckle.

With reference to FIGS. 1*a*, 1*b* and 2*a*, 2*b*, 2*c*, 10 indicates the whole of a buckle for the rapid adjustment of a strap.

It comprises a female part 12 and a male part 14, each having means of connection to parts of articles of clothing, equipment or accessories to be fastened together. These connection means are, for example, in the form of seats to be wrapped with tapes or strips of fabric coupled to flaps or portions of the articles of clothing, equipment or accessories.

In particular, the female part 12 is provided with a transverse slot 20 allowing the passage of a portion of a first tape (not shown) connected to a corresponding first element of a garment, accessory or equipment, and allowing the tape to be wrapped around a cross-piece 22 on which this portion of tape can be fixed by stitching or welding.

The male part 14 has a labyrinth-like seat formed by at least one pair of cross-pieces 24', 24" extending between two cheeks 26 of a main body, so as to delimit a pair of slots 28', 28" which define a tortuous path for the adjustable wrapping of a portion of a second tape (not shown) connected to a corresponding second element of a garment, accessory or equipment intended to be joined to the aforesaid first element.

The male part 14 includes a tab formation 30 extending axially from a base of the main body, to which the cheeks 26 are connected, in a longitudinal direction coinciding with the direction of coupling of the parts of the buckle.

The tab formation 30, formed by a single integral tab in this case, having its structure lightened by a series of central holes 32 if necessary, has toothed lateral edges 34*a*, 34*b*, each of which forms a plurality of transverse seats 36*a* and 36*b* respectively, for engagement by fastening members of the buckle associated with the female part 12, which are described more fully below.

The number 40 indicates an operating mechanism of the buckle which can be coupled removably to the female part, and which forms a pair of buckle release buttons 42 which can be operated manually by pressing in a direction transverse to the buckle to disengage the male part 14 from the female part 12 and enable the strap to be adjusted.

FIG. 3 shows the female part 12 of the buckle. It comprises an integral body 50 in which a cavity 51 is formed for the insertion of the male part. Specifically, the numbers 52' and 52" indicate a corresponding pair of apertures for the entry and exit of the tab 30.

The body 50 is of generally cylindrical shape except for a tangential handle formation which forms the cross-piece 22 and defines the slot 20 for the connection of a tape for joining to the article of clothing or accessory to be fastened. A cylindrical cavity 54 is provided inside the body in a direction transverse to the buckle, forming a seat for the operating mechanism 40.

FIGS. 4*a* and 4*b* show the male part 14 of the buckle according to the invention. The drawings show in greater detail the toothed lateral edges 34*a*, 34*b* of the tab 30, each of these edges defining a corresponding plurality of engagement seats 36*a*, 36*b* for adjusting the relative positions of the male part and the female part in the coupled state.

Each toothing is formed on a corresponding lateral edge of the tab and emerges on a dorsal face 56 or ventral face 58, respectively, of the tab. Each intermediate tooth between the engagement seats 36*a*, 36*b* has an inclined front guiding surface 60 and a perpendicular rear surface 62.

An operating mechanism 40 for the buckle according to the invention will now be described with reference to FIGS. 5, 6*a*, 6*b* and 6*c*.

The operating mechanism 40 includes a pair of movable fastening and operating members 70*a*, 70*b*, positioned at least partially facing each other and offset in the transverse direction of the buckle, in other words in a local longitudinal direction of the operating mechanism 40.

Each fastening and operating member 70*a*, 70*b* carries a corresponding fastening tooth 72, the teeth being located on opposite sides of the longitudinal direction of coupling of the buckle so as to form a transverse aperture 74 between them for the insertion of the tab 30 of the male part.

The female part 12 and the male part 14 can be fixed to each other by engaging the fastening teeth 72 in the seats 36*a*, 36*b* in a locking position, so as to prevent the sliding of the parts relative to each other, and can be made slidable with respect to each other in a release position by disengaging the fastening members from the said seats.

Each of the fastening teeth 72 has a first (front) inclined surface for interaction with the front guiding inclined surface 60 of the teeth of the tab 30 in a direction of insertion of the tab into the female part, thus allowing the tab to be advanced and snap-fitted into a plurality of adjustment positions, and a second perpendicular (rear) surface for interacting with the perpendicular rear surface 62 of the teeth of the tab 30 in a direction of extraction of the tab of the female part, thus preventing the reverse movement of the tab.

Each fastening and operating member 70*a*, 70*b* includes a corresponding supporting cross-piece 76, from the end of which there extends a pair of projecting functional appendages, forming, respectively, an operating button 42 on a base surface of the operating mechanism 40, and a support 78 of the corresponding fastening tooth, in a transverse section inside the mechanism and on the opposite side of the longitudinal direction of the buckle from the corresponding operating button.

Resiliently deformable joining members 80 join the two fastening and operating members 70*a*, 70*b* together, thus permitting a relative transverse sliding movement to bring the fastening teeth either towards or away from each other, and therefore the operating mechanism 40, considered as a whole, forms an integral structure with variable transverse extension and has a cylindrical envelope resulting from the axial interpenetration of the envelopes of each fastening and operating member 70*a*, 70*b*.

The joining members 80 are made in the form of flexible links which have an undulating configuration so as to guide their deformation in the local longitudinal direction of the operating mechanism 40 according to the relative movement of the fastening and operating members 70*a*, 70*b*. These flexible links act as wave springs and can assume a predetermined longitudinal extension when at rest, establishing a first relative position of the two fastening and operating members 70*a*, 70*b* such that the dimension of the transverse aperture 74 between the fastening teeth 72 is substantially smaller than the transverse dimension of the tab formation 30 which it is intended to receive, and a deformed configuration resulting from the operation of the button means 42 which establishes a second relative position of the two fastening and operating members 70*a*, 70*b* in which the fastening teeth 72 are moved away from each other in such a way that the dimension of the transverse aperture 74 is substantially greater than the transverse dimension of the tab formation 30.

The operating mechanism 40 has a locking tooth 90 emerging flexibly from the surface of the cross-piece 76 of one of the two fastening and operating members, which in the illustrated example is the member indicated by the reference 70*a*, this tooth being engageable by snap-fitting into a corresponding recess 92 formed in the wall of the seat 54 for housing the mechanism 40 in the female part 12 of the buckle.

The operating mechanism 40 also has a guide channel 94 formed on the surface of the cross-piece 76 of the fastening and operating member opposite that which bears the locking tooth 90, this channel being capable of interacting with a centring rib 96 projecting into the seat 54 for housing the mechanism.

On one fastening and operating member (70*b*), on the base which forms the corresponding operating button 42 opposite the locking tooth 90, the operating mechanism 40 has a pair of radially projecting backing fins 98 for interaction with a stop surface (not shown) formed inside the housing seat 54 so as to define a limit position for the movement of the mechanism in the aforesaid seat.

In the assembled state, in which the operating mechanism 40 is inserted into its seat provided in the body of the female part, the corresponding locking tooth is received in the recess 92 and the fins 98 interact with the stop surface formed in the seat for housing the mechanism, the resilient joining members 80 are conveniently pre-loaded by compression.

FIGS. 7-10 show a variant embodiment of the buckle described with reference to FIGS. 1-6, in which elements identical to those described in the illustration of the embodiment of FIGS. 1-6 are identified by the same reference numerals.

In the tab formation 30, each toothing is formed in a corresponding longitudinal thickening rib 110*a*, 110*b* of the tab formation. The pair of longitudinal ribs 110*a*, 110*b* forms corresponding longitudinal grooves 112', 112" on both faces of the tab formation, at least one of these grooves being capable of interacting with a projection 114 in an entry aperture 52' of the body of the female part in order to centre the tab formation in its insertion into the female part.

Conveniently, it is possible for the said centring groove not to extend over the whole length of the tab formation 30, but to end at a certain distance from the front transverse edge, so as to define a shoulder or similar projecting end stop portion for preventing the tab formation from being completely pulled out of the cavity of the female part.

As an alternative to the backing fins 98, the operating mechanism 40 has, in the guide channel 94 formed in the surface of the cross-piece 76 of the fastening and operating member opposite the surface carrying the locking tooth 90, a backing projection 120 projecting radially into the guide channel, for interaction with one end of the mechanism centring rib 96, so as to define a limit position for the movement of the mechanism in the seat.

Advantageously, by forming the operating mechanism separately from the female part of the buckle, it is possible to use an injection moulding method even for the formation of complex mechanisms.

The buckle is pre-assembled by snap-fitting the operating mechanism 40 into the cylindrical housing seat 54 formed in the body of the female part, and locking the mechanism in position by the engagement of the locking tooth 90 in the recess 92 provided in the seat, and by the bearing of the backing fins 98 on an internal section of the seat in the direction opposite the retaining action of the tooth, or, alternatively, as a result of the bearing of the backing projection 120 projecting from the guide channel 94 on one end of the mechanism centring rib 96.

The operation of the buckle is automatic in the direction in which the male part is coupled to the female part. Following the operation of fully inserting or introducing the tab 30 into the cavity of the female part, as a result of the pressure exerted by the front inclined guiding surface 60 of the teeth of the tab 30 on the front inclined surface of the fastening teeth 72 with respect to which they form a wedge arrangement, the transverse aperture 74 between the fastening teeth is increased until it is possible to advance and snap-fit the tab.

The increase of the transverse aperture is made possible by the deformation of the flexible joining links 80 between the two fastening and operating members 70*a*, 70*b* which form the operating mechanism.

Between one tooth and the next, the fastening teeth 72 move towards each other again, thus engaging the intermediate seat 36 by the resilient return of the links 80 to the longitudinal extension of their resting state.

However, a reverse movement in the direction of extraction is prevented by the interference between the corresponding rear faces of the fastening tooth and of the teeth of the tab 30, orientated orthogonally to the direction of extraction.

The operation of the button means 42, which are pressed between the thumb and index finger of one hand, creates a relative transverse sliding movement of the fastening and operating members 70*a*, 70*b* due to the deformation of the flexible joining links 80, specifically in a direction in which the fastening teeth 72 move away from each other until they reach a relative arrangement in which the dimension of the transverse aperture 74 between these teeth is substantially greater than the transverse dimension of the tab 30, permitting its temporary release and consequently the loosening or unfastening of the buckle.

With reference to FIGS. 11*a*, 11*b* and 11*c*, the number 200 indicates the whole of a buckle for the rapid connection of accessories, such as bags, rucksacks or equipment for sports or leisure purposes, or of flaps of articles of clothing.

It comprises a female part 212 and a male part 214, each having means of connection to parts of articles of clothing, equipment or accessories to be joined together, for example in the form of seats to be wrapped with straps or strips of fabric coupled to flaps or portions of the articles of clothing or accessories.

In particular, the female part 212 is provided with a transverse slot 220 allowing the passage of a portion of a first tape (not shown) connected to a corresponding first element of a garment, accessory or equipment, and allowing the tape to be wrapped around a cross-piece 222, on which this portion of tape can be fixed by stitching or welding. The male part 214 has a labyrinth-like seat formed by at least one pair of cross-pieces 224', 224" extending between two cheeks 226 of a main body, so as to delimit a pair of slots 228', 228" which define a tortuous path for the adjustable wrapping of a portion of a second tape (not shown) connected to a corresponding second element of a garment, accessory or equipment intended to be joined to the aforesaid first element.

The male part 214 includes a tab formation 230 extending axially from a base of the main body, to which the cheeks 226 are connected, in a longitudinal direction coinciding with the direction of coupling of the parts of the buckle.

The tab formation 230, formed by a single integral tab in this case, has a transverse seat 236*a*, 236*b* on each lateral edge 234*a*, 234*b* respectively, for engagement by a corresponding fastening member of the buckle associated with the female part 212, as described below.

The number 240 indicates an operating mechanism of the buckle, which can be coupled removably to the female part by snap-fitting its locking tooth 290 into the recess 292 formed in the seat for housing the mechanism 240 in the female part 212 of the buckle, this mechanism forming a pair of buttons 242 for releasing the buckle which can be operated manually by pressing in a direction transverse to the buckle in order to disengage the male part 214 from the female part 212, thus enabling the strap to be adjusted.

The female part 212 of the buckle and the associated operating mechanism 240 have configurations similar to those described with reference to the embodiment of the strap adjustment buckle, and are therefore not described further.

FIG. 11*c* shows the male part 214 of the buckle, which differs in its tab formation 230 from the male part 14 of the strap adjusting buckle.

Each of the lateral edges 234*a*, 234*b* has a single front tooth formation 235*a*, 235*b*, each of which forms a corresponding engagement seat 236*a*, 236*b* behind it in a direction of approach to the main body of the element.

The tooth formations 235*a* and 235*b* and the corresponding seats 236*a* and 236*b* emerge, respectively, on a dorsal face 256 and a ventral face 258 of the tab formation 230.

The tooth formations 235*a* and 235*b* define a shaped front transverse edge of the tab 230, such that it has inclined guiding surfaces 260 for interaction with corresponding first inclined surfaces of the fastening teeth of the operating mechanism 240 in a direction of insertion of the tab into the female part, thus enabling the tab formation to be inserted by snap-fitting. A tooth formation 235*a*, 235*b* also defines a perpendicular rear stop surface 262 which forms the front face of the corresponding seat 236*a*, 236*b* and is adapted to interact with corresponding second perpendicular surfaces of the fastening teeth in a direction of extraction of the tab from the female part, so as to prevent the reverse movement of the tab.

The operation of the buckle is similar to that described previously with reference to the buckle for adjusting a strap, the sole difference being that the action of inserting the tab 230 into the cavity of the female part is carried out by expanding the transverse aperture between the fastening teeth as a result of the pressure exerted by the shaped front transverse edge of the tooth formations 235*a* and 235*b* on the front inclined surface of the fastening teeth, and the male and female parts are snap-fitted together in the sole permitted fastening position, in which the fastening teeth engage the seat 236.

Naturally, the principle of the invention remaining the same, the forms of embodiment and details of construction may be varied widely with respect to those described and illustrated, which have been given purely by way of non-limiting example, without thereby departing from the scope of protection of the present invention as defined by the attached claims.

This is true, in particular, in the case in which the tab formation is composed by the juxtaposition of a pair of longitudinal tabs extending from corresponding male elements which can be coupled in a side-by-side arrangement to the female part.

The invention claimed is:

1. A buckle comprising a female part (12; 212) and a male part (14; 214), each having cross-pieces (22; 24', 24"; 222; 224', 224") for connection to corresponding elements of articles of clothing or accessories to be fastened or coupled together, wherein the said female part (12; 212) is provided with a cavity for the insertion of an axial tab formation (30; 230) which is carried by the male part (14; 214) and which has transverse seats (36*a*, 36*b*; 236*a*, 236*b*) for engagement by fastening means (72) associated with the said female part (12; 212) and projecting into the cavity, these means being adapted to assume a locking position in which they engage in the said seats (36*a*, 36*b*; 236*a*, 236*b*) so as to prevent the sliding of the male part (14; 214) and the female part (12; 212) relative to each other, in a fastened condition of the buckle, and a release position in which they are disengaged from the said seats (36*a*, 36*b*; 236*a*, 236*b*), thus permitting the relative sliding of the tab formation (30; 230) in the cavity, in an unfastened condition of the parts of the buckle, in which:

the said tab formation (30; 230) has at least one pair of the said seats (36*a*, 36*b*; 236*a*, 236*b*) for receiving the said fastening means (72), formed at the opposite lateral edges (34*a*, 34*b*; 234*a*, 234*b*), the said fastening means (72) comprise a pair of teeth, located on opposite sides of a longitudinal direction of coupling of the buckle, which define between them a transverse aperture (74) for the insertion of the tab formation (30; 230), and the buckle comprises button-like release means (42; 242) connected to the said fastening means (72) and operable manually by pressing in a direction transverse to the buckle to disengage the said fastening means (72) from the seats (36*a*, 36*b*; 236*a*, 236*b*) of the tab formation (30; 230), the fastening teeth (72) and the release means (42; 242) acting in coinciding or parallel transverse directions, so that the simultaneous pressing of the buttons (42; 242) towards each other causes the fastening teeth (72) to move away from each other, thus expanding the said transverse aperture (74), in other words causing the fastening teeth (72) to move away from the engagement seats (36*a*, 36*b*; 236*a*, 236*b*) on the tab formation (30; 230)

there is a separate operating mechanism (40; 420) carrying the said fastening means (72), which can be coupled removably to the female part (12; 212), this mechanism including a pair of movable fastening and operating members (70*a*, 70*b*), positioned at least partially facing each other and offset in the transverse direction, each of these carrying a corresponding fastening tooth (72) and forming the corresponding operating button (42; 242), the buttons being located on opposite sides of the longitudinal direction of the buckle, and the said pair of fastening and operating members (70*a*, 70*b*) being joined by resiliently deformable joining members (80) in such a way as to permit their transverse relative movement to move the fastening teeth (72) towards or away from each other, so that the said mechanism (40; 240) forms an integral structure with a variable transverse extension; and said female part (12; 212) has a transverse cylindrical seat (54) for housing the operating mechanism (40; 240).

2. A buckle according to claim 1, in which each fastening tooth (72) is fixed to the corresponding operating button (42; 242).

3. A buckle according to claim 1, in which the said joining members (80) comprise corresponding resilient opposing means which can assume a predetermined longitudinal extension when at rest, establishing a first relative position of the two fastening and operating members (70*a*, 70*b*) so as to form a transverse aperture (74) between the fastening teeth (72) substantially smaller than the transverse dimension of the tab formation (30; 230), and a deformed configuration on the operation of the button means (42; 242) which establishes a second relative position of the two fastening and operating members (70*a*, 70*b*) in which the fastening teeth (72) are moved away from each other in such a way as to form an aperture (74) whose transverse dimension is substantially greater than the transverse dimension of the tab formation (30; 230).

4. A buckle according to claim 1, in which the said resilient opposing means comprise flexible links which have an undulating configuration such that their deformation is guided in the longitudinal direction of the operating mechanism (40; 240) according to the relative movement of the said fastening and operating members (70*a*, 70*b*).

5. A buckle according to claim 4, in which each fastening and operating member (70*a*, 70*b*) includes a supporting cross-piece (76) from the ends of which a pair of functional appendages project to form, respectively, an operating button (42; 242) on an outer base surface of the operating mechanism (40; 240) and a support (78) for the corresponding fastening tooth (72) in a transverse section inside the mechanism (40; 240).

6. A buckle according to claim 5, wherein the operating mechanism (40; 240) has a cylindrical envelope resulting from the axial interpenetration of each fastening and operating member (70*a*, 70*b*).

7. A buckle according to claim 5, in which the said operating mechanism (40; 240) has a locking tooth (90) emerging from the surface of the cross-piece (76) of one of the two fastening and operating members (70*a*, 70*b*) and adapted to be snap-fitted into a corresponding recess (92) formed in a wall of the seat (54) housing the mechanism (40; 240) to couple the operating mechanism (40; 240) stably to the female part (12; 212).

8. A buckle according to claim 7, in which the said operating mechanism (40; 240) has a guide channel (94) on the surface of the cross-piece (76) of the fastening and operating member (70*b*) opposite the member (70*a*) which bears the locking tooth (90), this channel being adapted to interact with a centering rib (96) projecting into the seat (54) for housing the mechanism (40; 240).

9. A buckle according to claim 8, in which the said operating mechanism (40; 240) has a backing projection (120) projecting radially into the guide channel (94), for interaction with a stop end of the centering rib (96) of the mechanism (40; 240) so as to define a limit position for the movement of the mechanism (40; 240) in the seat (54).

10. A buckle according to claim 1, in which each fastening tooth (72) has a first inclined surface and a second perpendicular surface, and the tab formation (230) includes a front transverse edge shaped so as to have inclined guiding surfaces (235*a*, 235*b*) for interaction with corresponding first inclined surfaces of the fastening teeth (72) in a direction of insertion of the tab formation (230) into the female part (212), thus permitting the insertion and snap-fitting of the tab formation (230), and front faces (262) of the engagement seats (236*a*, 236*b*) which are perpendicular so as to have stop surfaces for interaction with corresponding second perpendicular surfaces of the fastening teeth (72) in a direction of extraction of the tab formation (230) from the female part (212), thus preventing the reverse movement of the tab formation.

11. A buckle according to claim 10, in which the said tab formation (30) has toothed lateral edges (34*a*, 34*b*), each of which forms a plurality of engagement seats (36*a*, 36*b*) of the fastening teeth (72) for the adjustment of the positions of the male part (14) and the female part (12) relative to each other, the edges (34*a*, 34*b*) having, for each intermediate tooth between consecutive engagement seats (36*a*, 36*b*), a front inclined guiding surface (60) for interaction with the first inclined surface of a corresponding fastening tooth (72) in a direction of insertion of the tab formation (30) into the female part (12), thus enabling the tab formation (30) to be advanced and snap-fitted into a plurality of adjustment positions, and a rear perpendicular surface (62) for interaction with corresponding second perpendicular surfaces of the fastening teeth (72) in a direction of extraction of the tab formation (30) from the female part (12), thus preventing the reverse movement of the tab formation.

12. A buckle according to claim 11, in which each toothing (34*a*, 34*b*) is formed in a corresponding longitudinal thickening rib (110*a*, 110*b*) of the tab formation (30), the pair of longitudinal ribs (110*a*, 110*b*) forming between them at least one centering groove (112') of the tab formation (30) for interaction with a projection (114) formed in an aperture (52') of the female part (12) for the insertion of the tab formation (30).

13. A buckle according to claim 12, in which the said groove (112', 112") has a limit stop projection on the front transverse edge adapted to prevent the complete extraction of the tab formation (30) from the cavity of the female part (12).

14. A buckle according to claim 1, in which the said tab formation is composed by the juxtaposition of a pair of longitudinal tabs extending from corresponding male elements which can be coupled in a side-by-side arrangement to the said female part.

15. A buckle according to claim 1, in which the said female part (12; 212) has a seat (20; 220) for the wrapping of a tape which can be connected to a corresponding first element of a garment or equipment, and the said male part (14; 214) has a labyrinth-like seat (28', 28"; 228', 228") for the adjustable wrapping of a tape which can be connected to a corresponding second element of a garment or equipment intended to be joined to the said first element connected to the female part (12; 212).

* * * * *